United States Patent [19]

Rousseau

[11] 4,176,263

[45] Nov. 27, 1979

[54] SWITCH FOR POCKET TORCH

[76] Inventor: Jean-Pierre Rousseau, 4, Andersen, L'Oree de Senart, 91210 Draveil, France

[21] Appl. No.: 863,735

[22] Filed: Dec. 23, 1977

[30] Foreign Application Priority Data

Jan. 11, 1977 [FR] France ..... 77 00618

[51] Int. Cl.[2] ..... F21V 23/00

[52] U.S. Cl. ..... 200/60; 362/197; 362/203; 362/802

[58] Field of Search ..... 200/60, 61.52, 6 BB, 200/315; 362/188, 190, 191, 194, 195, 196, 197–199, 200–206, 268, 802, 154, 155, 157, 208, 251, 394; 20/60

[56] References Cited

U.S. PATENT DOCUMENTS

| | | | |
|---|---|---|---|
| 2,166,657 | 7/1939 | Evelyn | 362/194 |
| 2,204,136 | 6/1940 | King et al. | 362/802 |
| 2,252,358 | 8/1941 | Tosi | 362/802 |
| 2,259,106 | 10/1941 | Hager | 200/60 |
| 2,329,790 | 9/1943 | Seigle | 362/802 |
| 3,974,347 | 8/1976 | Lockard | 200/6 R |
| 4,070,555 | 1/1978 | Carli | 200/6 BB X |

FOREIGN PATENT DOCUMENTS

| | | | |
|---|---|---|---|
| 847999 | 7/1970 | Canada | 200/60 |

*Primary Examiner*—James R. Scott
*Attorney, Agent, or Firm*—Brisebois & Kruger

[57] ABSTRACT

In a pocket torch the bulb itself is used as the switch. It tilts between two positions of stable equilibrium, while being confined resiliently between the casing and the battery.

6 Claims, 3 Drawing Figures

SWITCH FOR POCKET TORCH

BACKGROUND OF THE INVENTION

The invention concerns pocket torches or similar articles and more particularly the switch of these torches.

A battery pocket torch necessarily includes a battery and an electric bulb, but also generally a support for the bulb, most often with a glass, reflector or lens, a casing generally in several parts containing everything, an electric circuit running from the two poles of the battery to the two terminals of the torch, and a switch interposed in this circuit. Among the large number of known pocket torches, the majority are for this reason relatively complex, and the simplest among them do not always give satisfaction, in particular as regards the switch and the quality of the contacts. This generally reveals itself by illumination of weak and variable brilliance, even with batteries in good condition.

The object of the invention is to produce a switch with clean contact, particularly for a pocket torch, which will nevertheless be of extremely great simplicity and of low cost.

The invention consists in using a bulb or a lamp assembly, the terminals of which are constituted by a central block and a lateral sleeve, and which comprises at the other extremity, through which the light is emitted, an enlarged portion followed by a reduced portion providing a shoulder on the enlarged portion, and in mounting this bulb between an abutment surface having an oblong notch for the passage of the reduced portion, and a planar surface substantially parallel to it, urged resiliently in the direction of the abutment surface, while permitting to the bulb a sufficient lateral play in a single direction corresponding to that of the notch, this play being such that the bulb automatically assumes a position inclined in one direction or the other, which corresponds to only two stable positions of equilibrium, being positions in which the central block remains in contact with the planar surface which serves to supply one of the electric polarities, while the lateral sleeve is in contact in one position with an insulating lateral wall and in the other position with a conducting lateral wall connected to the other polarity, in such a way that the lighting and extinguishing of the torch are obtained by simple tilting of the bulb by acting on the reduced portion passing through the notch.

The planar abutment surface may in particular be constituted directly by the negative bottom of an elongated battery, which latter is urged axially, in its seating by a spring engaging against its positive end in such a way that the switch, operating in the manner of a tumbler, employs the bulb as its sole constituent component, the usual battery and contact spring and the housing itself being able to be extremely simplified and the electric circuit reduced to a conducting element constituting the lateral conducting wall and connected to the spring, this conducting element being able to constitute a part of the housing itself or of the spring.

BRIEF DESCRIPTION OF THE DRAWINGS

Other details of the invention will appear in the description which will follow of one embodiment taken by way of example, and shown in the accompanying drawing, in which.

DESCRIPTION OF THE PREFERRED EMBODIMENT

Figure 1:
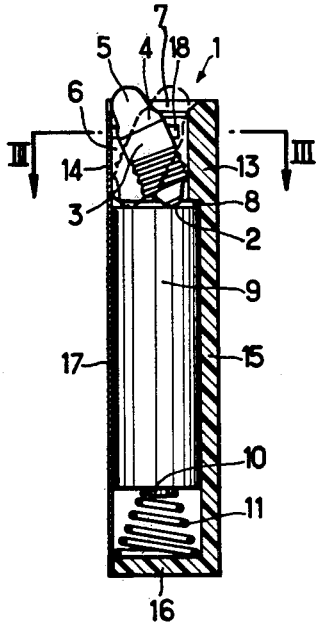
FIG. 1 is an axial section of the torch.
Figure 2:
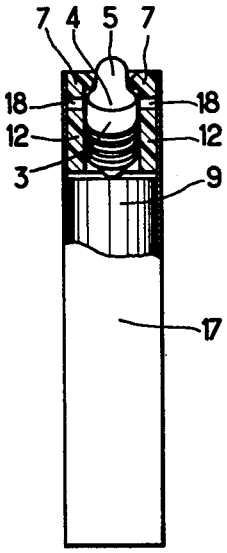
FIG. 2 is a view in elevation perpendicular to the direction of FIG. 1 with partial breaking away.

In its most simple form, the torch employs an electric bulb 1 of the type on the market under the name bulb with lens and including a central conducting block 2 constituting one of the supply terminals and a lateral sleeve 3 constituting the other supply block. Its glass portion includes an enlarged base 4 followed by a part 5 of lesser diameter, itself terminated by the lens, this part of lesser diameter thus producing a kind of rounded shoulder constituted by the base 4.

Such a bulb is arranged in a seating 6 which is substantially parallelepipedal, closed by a terminal abutment face 7 at the end of the torch, this face being broken by an oblong opening the width of which is just enough to permit passage of the narrow part 5 of the bulb, but insufficient to permit the passage of the base 4, so that the shoulder referred to above abuts against the surface 7 while being able to slide along this surface. Opposite this abutment wall 7, and parallel to the latter, is arranged a planar abutment surface 8 which is, in the present case, the negative conducting surface of the bottom of an elongated battery 9, the positive terminal 10 of which is placed at the lower end as indicated in FIG. 1. This surface 8, as well as the battery 9, is urged axially in the direction towards the abutment surface 7 by a spring 11 engaging against the terminal 10.

The parallelepipedal seating 6 also includes two lateral walls 12 which are insulating or insulated, providing between them just sufficient play to permit insertion of the bulb. Finally, in the third direction, the parallelepipedal seating 6 is limited at the right-hand side of FIGS. 1 and 3 by a wall 13 which is insulating or insulated from the rest of the circuit, and on the left-hand side by a wall 14 which is conducting, at least for the part of the surface capable of being engaged by the sleeve 3, this conducting surface being moreover connected to the spring 11.

Figure 3:
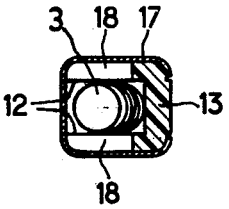
FIG. 3 is a transverse section along III—III of FIG. 1.

In the example, all the insulating parts mentioned constitute the walls of a single piece 15 of plastics material moulded in the form of a trough, with a lower flange 16 for abutment of the spring 11 and an upper part of U-section visible in FIG. 3, as well as a conducting cover 17 of thin metal of C-section, fitted onto the previous component by axial sliding up to an abutment not shown, to constitute at the same time three of the side faces of the casing as well as the conducting wall 14 and the connection between this wall and the spring 11, which latter includes for this purpose a bottom turn of a diameter slightly greater than the internal width of the component 17 so as to rub against the latter.

One will thus see that with two extremely simple components 15 and 17, plus the usual battery spring 11, as well as naturally a battery 9 and a bulb 1, one obtains an extremely economical pocket torch, the switching on of which can be obtained simply by pushing the tip 5 of the bulb towards the right in FIG. 1 to make the bulb tilt from its position in solid lines to its position in broken lines in FIG. 1. This tilting simply requires that the distance between the surfaces 13 and 14 should be sufficiently great so that the two positions of stable equilibrium should be clearly defined and separated from one another, the tilting being moreover facilitated by lubricating the surface 8 of the battery. The movement produces a very distinct switching action, like a usual tumbler switch, and the contacts are extremely good thanks to the pressure of the spring 11 and moreover are constantly cleaned by the to-and-fro movements.

By way of refinement, one can separate the two parts of the wall 7 situated on one side and the other of the slot by two small openings 18, to give to them a certain elasticity, in such a way that if the torch falls on the ground, landing on its end 16, the rebound of the battery consequent on its inertia will be absorbed by this resilience and avoids breakage of the bulb.

Naturally, the threaded part of the sleeve 3 performs absolutely no function, so that one could use any other kind of sleeve. One could also use any other type of bulb, provided it is mounted in a tilting lamp assembly having the characteristics mentioned, that is to say on one side a central block 2 and a peripheral conducting part, and on the other side a shoulder 4 at the base of a reduced part 5.

In the same way, one could use any kind at all of battery or rechargeable battery and the abutment surface 8 could possibly be constituted by an intermediate adapter washer in contact with one of the terminals of the battery, which could equally well be the negative terminal or the positive terminal. This intermediate adapter component could likewise assume the shape of a stamped-out piston, which would then permit placing the spring inside that piston, between it and the battery, the latter being then in this case immovable. Naturally, in all these cases, the periphery of this adapter should be insulated from the wall 14.

Finally, the conducting wall 14 could possibly be constituted by a vertical extension of the spring 11, of wire or strip, and be possibly placed at the right-hand side, that is to say at the bottom of the U-shaped cross section, the component 17 being then in this case likewise of insulating material, moulded or extruded.

The switch according to the invention is usable for all pocket torches or similar battery casings, but it can also be used advantageously as a switch with another type of supply. In particular, it is possible to produce a switch operating on the mains, the tilting part of which could be constituted by a tell-tale lamp or by a fuse, or again by combination of both, the planar abutment surface 8 being naturally in this case any kind of conducting surface subjected to resilient action.

I claim:

1. A flashlight comprising a casing, means defining an elongated slot extending through said casing, a light bulb in said casing, said bulb having a lens end having a tip surrounded by a shoulder, said tip extending into the slot from within the casing and being exposed for manual manipulation from outside the casing, and said shoulder engaging the casing at each side of the slot to retain the bulb in the casing, said bulb having a base with an end terminal and a side terminal, means defining a generally parallelepedic space in said housing for guiding said bulb between a first position and a second position, a battery in the casing, a conductive terminal in said casing engaging said end terminal of said bulb and connecting the bulb to a first terminal of the battery, resilient means for urging said terminal toward said bulb, a conductive element in said casing at one side of said space for engaging said bulb in said first position and for connecting said side terminal of the bulb to a second terminal of the battery, insulating means in said casing at the other side of said space for insulating said bulb from said second terminal in said second position of said bulb, said slot, parallelepid space, conductive terminal, and resilient means comprising means mounting said bulb for snap over center movement between said first and second positions in response to manual manipulation of said exposed tip of the bulb so that the bulb remains in its manually set position and functions as the switch of the flashlight.

2. A flashlight according to claim 1, wherein said battery is slidably mounted in said chamber, said conductive terminal is said first terminal of said battery, and said resilient means is a conducting compression spring located between said conductive element and said second terminal of the battery.

3. A flashlight according to claim 1, wherein said casing comprises a metal cover of C-section sliding on a single piece of insulating moulded material, said metal cover comprising said conductive means for connecting said side terminal of the bulb to said second terminal of the battery.

4. A flashlight according to claim 3, wherein said conductive means for connecting said side terminal of the bulb to the second terminal of the battery further comprises, a conductive spring between said second terminal and an end wall of the casing, said spring including a turn having an unstressed diameter greater than the internal width of the cover to contact said cover, said spring comprising said means for moving said terminal toward said light bulb.

5. A flashlight according to claim 1, wherein said casing includes an insulating material body of one piece construction having said slot formed therein and defining said parallelepedic space.

6. A flashlight according to claim 5, wherein portions of said body adjacent said elongated slot and against which said shoulder of the bulb abuts comprise, resilient portions to minimize the danger of damage to the bulb.

* * * * *